US010151064B2

(12) United States Patent
Nonni et al.

(10) Patent No.: US 10,151,064 B2
(45) Date of Patent: Dec. 11, 2018

(54) SOFTWOOD KRAFT FIBER HAVING AN IMPROVED α-CELLULOSE CONTENT AND ITS USE IN THE PRODUCTION OF CHEMICAL CELLULOSE PRODUCTS

(71) Applicant: GP CELLULOSE GMBH, Zug (CH)

(72) Inventors: Arthur J. Nonni, Peachtree City, GA (US); Charles E. Courchene, Snellville, GA (US); Philip Reed Campbell, Gulf Shore, AL (US); Steven Chad Dowdle, Pace, FL (US); Joel Mark Engle, Purvis, MS (US); Blair Roderick Carter, Marietta, GA (US); Christopher M. Slone, Atlanta, GA (US)

(73) Assignee: GP Cellulose GmbH, Zug (CH)

( * ) Notice: Subject to any disclaimer, the term of this patent is extended or adjusted under 35 U.S.C. 154(b) by 544 days.

(21) Appl. No.: 14/766,316

(22) PCT Filed: Feb. 6, 2014

(86) PCT No.: PCT/IB2014/000680
§ 371 (c)(1),
(2) Date: Aug. 6, 2015

(87) PCT Pub. No.: WO2014/122533
PCT Pub. Date: Aug. 14, 2014

(65) Prior Publication Data

US 2016/0002849 A1 Jan. 7, 2016

Related U.S. Application Data

(60) Provisional application No. 61/762,532, filed on Feb. 8, 2013, provisional application No. 61/782,035, filed on Mar. 14, 2013, provisional application No. 61/789,610, filed on Mar. 15, 2013.

(51) Int. Cl.

| | |
|---|---|
| ***D21C 9/16*** | (2006.01) |
| ***D21C 9/147*** | (2006.01) |
| ***D21C 9/10*** | (2006.01) |
| ***D21C 3/02*** | (2006.01) |
| ***D21C 3/24*** | (2006.01) |
| ***D21C 9/14*** | (2006.01) |

(52) U.S. Cl.
CPC ..... *D21C 9/163* (2013.01); *D21C 3/02* (2013.01); *D21C 3/24* (2013.01); *D21C 9/1026* (2013.01); *D21C 9/1036* (2013.01); *D21C 9/144* (2013.01); *D21C 9/147* (2013.01)

(58) Field of Classification Search
CPC ..... D21C 9/1026; D21C 9/1036; D21C 9/163
See application file for complete search history.

(56) References Cited

U.S. PATENT DOCUMENTS

| | | | | |
|---|---|---|---|---|
| 1,860,431 | A | 5/1932 | Richter | |
| 2,112,116 | A | 3/1938 | Richter | |
| 2,368,527 | A | 1/1945 | Edelstein | |
| 2,749,336 | A | 6/1956 | Boddicker et al. | |
| 2,978,446 | A | 4/1961 | Battista et al. | |
| 3,728,331 | A | 4/1973 | Savage | |
| 3,868,955 | A | 3/1975 | Steiger et al. | |
| 4,410,397 | A | 10/1983 | Kempf | |
| 4,626,319 | A * | 12/1986 | Kruger | D21C 9/10 162/65 |
| 4,661,205 | A | 4/1987 | Ow et al. | |
| H479 | H | 6/1988 | Wood et al. | |
| 5,302,248 | A | 4/1994 | Weinstock et al. | |
| 5,346,589 | A | 9/1994 | Braunstein et al. | |
| 5,447,602 | A | 9/1995 | Sajbel et al. | |
| 5,522,967 | A | 6/1996 | Shet | |
| 5,552,019 | A | 9/1996 | Weinstock et al. | |
| 5,562,645 | A | 10/1996 | Tanzer et al. | |
| 5,580,485 | A | 12/1996 | Feringa et al. | |
| 5,593,543 | A | 1/1997 | Balos et al. | |
| 5,630,906 | A | 5/1997 | Boe et al. | |
| 5,639,348 | A | 6/1997 | Payton et al. | |
| 5,703,225 | A | 12/1997 | Shet et al. | |
| 5,853,428 | A | 12/1998 | Collins et al. | |
| 5,876,625 | A | 3/1999 | Collins et al. | |
| 5,994,531 | A | 11/1999 | Doenges et al. | |
| 6,048,437 | A | 4/2000 | Fukushima et al. | |
| 6,099,586 | A | 8/2000 | Collins et al. | |
| 6,100,441 | A | 8/2000 | Blomstrom et al. | |
| 6,136,223 | A | 10/2000 | Collins et al. | |
| 6,146,494 | A | 11/2000 | Seger et al. | |

(Continued)

FOREIGN PATENT DOCUMENTS

| | | |
|---|---|---|
| CA | 1129161 | 8/1982 |
| CA | 2075875 A1 | 8/1992 |

(Continued)

OTHER PUBLICATIONS

TAPPI, T236 Kappa number of pulp, 1999.*
Gullichsen editor, Chemical Pulping 6A, 1999, Fapet Oy, p. A616-A665.*
van Heiningen et al., A chemical Reactor Analysis of Industrial Oxygen Delignification, 2003, PAPTAC Annual Meeting.*
Ahvenlampi et al., Energy efficient control techniques in continuous cooking application, 2010, IFAC Proceedings Volumes, vol. 43, Issue 1, p. 297-302.*
Rydholm, Pulping Processes, 1965, Interscience Publishers,chapter 15.*

(Continued)

*Primary Examiner* — Anthony Calandra
(74) *Attorney, Agent, or Firm* — Finnegan, Henderson, Farabow, Garrett & Dunner L.L.P.; Jeffrey A. Freeman; Ram W. Sabnis

(57) ABSTRACT

A bleached softwood kraft pulp fiber with high α-cellulose content and a low CED viscosity is provided, A surfactant treated fiber useful in the production of chemical derivatives is also described. Methods for making the kraft pulp fiber and products made from it are also described.

17 Claims, No Drawings

(56) References Cited

U.S. PATENT DOCUMENTS

| | | | |
|---|---|---|---|
| 6,210,801 | B1 | 4/2001 | Luo et al. |
| 6,214,976 | B1 | 4/2001 | Watanabe et al. |
| 6,221,487 | B1 | 4/2001 | Luo et al. |
| 6,228,126 | B1 | 5/2001 | Cimecioglu et al. |
| 6,235,154 | B1 | 5/2001 | Jiang |
| 6,235,392 | B1 | 5/2001 | Luo et al. |
| 6,241,779 | B1 | 6/2001 | Collins et al. |
| 6,306,334 | B1 | 10/2001 | Luo et al. |
| 6,319,361 | B1 | 11/2001 | Smith et al. |
| 6,331,354 | B1 | 12/2001 | Sealey, II et al. |
| 6,368,456 | B1 | 4/2002 | Cimecioglu et al. |
| 6,379,494 | B1 | 4/2002 | Jewell et al. |
| 6,398,908 | B1 | 6/2002 | Hermansson et al. |
| 6,432,266 | B1 | 8/2002 | Fukushima et al. |
| 6,440,523 | B1 | 8/2002 | Sealey, II et al. |
| 6,440,547 | B1 | 8/2002 | Luo et al. |
| 6,444,314 | B1 | 9/2002 | Luo et al. |
| 6,471,727 | B2 | 10/2002 | Luo et al. |
| 6,491,788 | B2 | 12/2002 | Sealey, II et al. |
| 6,511,930 | B1 | 1/2003 | Luo et al. |
| 6,514,613 | B2 | 2/2003 | Luo et al. |
| 6,515,049 | B1 | 2/2003 | Doenges et al. |
| 6,518,419 | B1 | 2/2003 | Van Der Lugt et al. |
| 6,524,348 | B1 | 2/2003 | Jewell et al. |
| 6,528,163 | B2 | 3/2003 | Sealey, II et al. |
| 6,540,876 | B1 | 4/2003 | Cimecioglu et al. |
| 6,541,627 | B1 | 4/2003 | Ono et al. |
| 6,562,195 | B2 | 5/2003 | Cimecioglu et al. |
| 6,582,559 | B2 | 6/2003 | Thornton et al. |
| 6,586,588 | B1 | 7/2003 | Cimecioglu et al. |
| 6,596,033 | B1 | 7/2003 | Luo et al. |
| 6,605,181 | B1 | 8/2003 | Bergqvist et al. |
| 6,605,350 | B1 | 8/2003 | Sealey, II et al. |
| 6,627,749 | B1 | 9/2003 | Kumar |
| 6,635,755 | B1 | 10/2003 | Jaschinski et al. |
| 6,685,856 | B2 | 2/2004 | Sealey, II et al. |
| 6,686,039 | B2 | 2/2004 | Sealey, II et al. |
| 6,686,040 | B2 | 2/2004 | Sealey, II et al. |
| 6,686,464 | B1 | 2/2004 | Harding et al. |
| 6,692,827 | B2 | 2/2004 | Luo et al. |
| 6,695,950 | B1 | 2/2004 | Cimecioglu et al. |
| 6,706,237 | B2 | 3/2004 | Luo et al. |
| 6,706,876 | B2 | 3/2004 | Luo et al. |
| 6,716,976 | B1 | 4/2004 | Jetten et al. |
| 6,765,042 | B1 | 7/2004 | Thornton et al. |
| 6,770,755 | B1 | 8/2004 | Gunnars et al. |
| 6,773,648 | B2 | 8/2004 | Luo et al. |
| 6,797,113 | B2 | 9/2004 | Sealey, II et al. |
| 6,821,383 | B2 | 11/2004 | Shore et al. |
| 6,824,645 | B2 | 11/2004 | Jaschinski et al. |
| 6,849,156 | B2 | 2/2005 | Besemer et al. |
| 6,861,023 | B2 | 3/2005 | Sealey, II et al. |
| 6,872,821 | B2 | 3/2005 | Cimecioglu et al. |
| 6,896,725 | B2 | 5/2005 | Thornton et al. |
| 6,916,466 | B2 | 7/2005 | Besemer et al. |
| 6,924,369 | B2 | 8/2005 | Doenges et al. |
| 6,936,710 | B2 | 8/2005 | Bragt et al. |
| 6,958,108 | B1 | 10/2005 | Vuorinen |
| 6,987,181 | B2 | 1/2006 | Jaschinski et al. |
| 7,001,483 | B2 | 2/2006 | Severeid et al. |
| 7,019,191 | B2 | 3/2006 | Looney et al. |
| 7,022,837 | B2 | 4/2006 | Harding et al. |
| 7,067,444 | B2 | 6/2006 | Luo et al. |
| 7,083,704 | B2 | 8/2006 | Sealey, II et al. |
| 7,090,744 | B2 | 8/2006 | Sealey, II et al. |
| 7,161,005 | B2 | 1/2007 | Schlingloff et al. |
| 7,247,722 | B2 | 7/2007 | Cimecioglu et al. |
| 7,252,837 | B2 | 8/2007 | Guo et al. |
| 7,279,177 | B2 | 10/2007 | Looney et al. |
| 7,326,317 | B2 | 2/2008 | Westermark et al. |
| 7,390,566 | B2 | 6/2008 | Luo et al. |
| 7,411,110 | B2 | 8/2008 | Sawyer et al. |
| 7,455,902 | B2 | 11/2008 | Weerawarna et al. |
| 7,456,285 | B2 | 11/2008 | Schlingloff et al. |
| 7,520,958 | B2 | 4/2009 | Tan et al. |
| 7,541,396 | B2 | 6/2009 | Luo et al. |
| 7,608,167 | B2 | 10/2009 | Luo et al. |
| 7,692,004 | B2 | 4/2010 | Schlingloff et al. |
| 7,700,764 | B2 | 4/2010 | Heijnesson-Hulten |
| 7,708,214 | B2 | 5/2010 | Medoff |
| 7,727,945 | B2 | 6/2010 | Rodrigues et al. |
| 7,867,358 | B2 | 1/2011 | Medoff |
| 7,867,359 | B2 | 1/2011 | Medoff |
| 7,939,101 | B2 | 5/2011 | Obae et al. |
| 7,947,292 | B2 | 5/2011 | Besemer et al. |
| 7,955,536 | B2 | 6/2011 | Sawyer et al. |
| 7,971,809 | B2 | 7/2011 | Medoff |
| 7,976,676 | B2 | 7/2011 | Yin et al. |
| 8,007,635 | B2 | 8/2011 | Tan et al. |
| 8,029,896 | B2 | 10/2011 | Kumamoto et al. |
| 8,044,013 | B2 | 10/2011 | Schlingloff et al. |
| 8,057,636 | B2 | 11/2011 | Vinson et al. |
| 8,084,391 | B2 | 12/2011 | Weerawarna |
| 8,372,765 | B2 | 2/2013 | Braig et al. |
| 2001/0025695 | A1 | 10/2001 | Patt et al. |
| 2001/0050153 | A1 | 12/2001 | Wajer et al. |
| 2005/0061455 | A1 | 3/2005 | Tan et al. |
| 2006/0070711 | A1 | 4/2006 | Luo |
| 2006/0159733 | A1 | 7/2006 | Pendharkar et al. |
| 2006/0260773 | A1 | 11/2006 | Tan et al. |
| 2007/0000627 | A1 | 1/2007 | Tan et al. |
| 2007/0119556 | A1 | 5/2007 | Tan et al. |
| 2007/0125507 | A1 | 6/2007 | Walter et al. |
| 2007/0199668 | A1 | 8/2007 | Scarpello et al. |
| 2007/0272377 | A1 | 11/2007 | Mei et al. |
| 2007/0277947 | A1 | 12/2007 | Nguyen |
| 2008/0188636 | A1 | 8/2008 | Argyropoulos et al. |
| 2008/0308239 | A1 | 12/2008 | Hart et al. |
| 2009/0044345 | A1 | 2/2009 | Schlingloff et al. |
| 2009/0054863 | A1 | 2/2009 | Tan et al. |
| 2009/0165968 | A1 | 7/2009 | Tan et al. |
| 2009/0312537 | A1 | 12/2009 | Medoff |
| 2010/0055437 | A1 | 3/2010 | Fink et al. |
| 2010/0124583 | A1 | 5/2010 | Medoff |
| 2010/0206501 | A1 | 8/2010 | Medoff |
| 2010/0233481 | A1 | 9/2010 | Isogai et al. |
| 2010/0282422 | A1 | 11/2010 | Miyawaki et al. |
| 2010/0316863 | A1 | 12/2010 | Kumamoto et al. |
| 2010/0320156 | A1 | 12/2010 | Olaiya et al. |
| 2011/0139383 | A1 | 6/2011 | Medoff |
| 2011/0287275 | A1 | 11/2011 | Tan et al. |
| 2012/0004194 | A1 | 1/2012 | Lu et al. |

FOREIGN PATENT DOCUMENTS

| | | |
|---|---|---|
| DE | 19620241 | 11/1997 |
| EP | 0172135 | 2/1986 |
| EP | 0 480 469 | 4/1992 |
| EP | 0716182 | 6/1996 |
| EP | 0647158 | 8/1997 |
| EP | 0845966 | 3/2000 |
| EP | 0999222 | 5/2000 |
| EP | 1077285 | 2/2001 |
| EP | 1106732 | 6/2001 |
| EP | 1154074 | 11/2001 |
| EP | 1156065 | 11/2001 |
| EP | 1093467 | 3/2002 |
| EP | 0889997 | 7/2002 |
| EP | 0923635 | 2/2003 |
| EP | 1300420 | 4/2003 |
| EP | 0787231 | 5/2003 |
| EP | 1228099 | 9/2003 |
| EP | 1025305 | 11/2003 |
| EP | 1068376 | 11/2003 |
| EP | 0511695 | 6/2004 |
| EP | 1430911 | 6/2004 |
| EP | 1155039 | 7/2004 |
| EP | 0863158 | 11/2004 |
| EP | 1077286 | 2/2005 |
| EP | 1541590 | 6/2005 |
| EP | 1278913 | 11/2005 |
| EP | 1155040 | 4/2006 |
| EP | 1383857 | 5/2006 |
| EP | 1245722 | 6/2006 |

(56) References Cited

FOREIGN PATENT DOCUMENTS

| | | |
|---|---|---|
| EP | 1230456 | 7/2006 |
| EP | 1676863 | 7/2006 |
| EP | 1311717 | 8/2006 |
| EP | 1137672 | 12/2006 |
| EP | 1743906 | 1/2007 |
| EP | 1668180 | 8/2007 |
| EP | 1862587 | 12/2007 |
| EP | 2084325 | 4/2010 |
| EP | 2216345 | 8/2010 |
| EP | 2226414 | 9/2010 |
| EP | 1694711 | 12/2010 |
| JP | S48-34522 | 10/1973 |
| JP | H08158284 A | 6/1996 |
| JP | 2002-506935 | 3/2002 |
| WO | WO 1991/05910 | 5/1991 |
| WO | WO 1992/014760 | 9/1992 |
| WO | WO 1994/020673 | 9/1994 |
| WO | WO 1994/021690 | 9/1994 |
| WO | WO 1995/006157 | 3/1995 |
| WO | WO 1995/026438 | 10/1995 |
| WO | WO 1995/034628 | 12/1995 |
| WO | WO 1995/035406 | 12/1995 |
| WO | WO 1996/009434 | 3/1996 |
| WO | WO 1996/020667 | 7/1996 |
| WO | WO 1996/038111 | 12/1996 |
| WO | WO 1998/003626 | 1/1998 |
| WO | WO 1998/056981 | 12/1998 |
| WO | WO 1999/009244 | 2/1999 |
| WO | WO 1999/047733 | 9/1999 |
| WO | WO 1999/047744 | 9/1999 |
| WO | WO 1999/057158 | 11/1999 |
| WO | WO 1999/057370 | 11/1999 |
| WO | WO 2000/026257 | 5/2000 |
| WO | WO 00/47812 | 8/2000 |
| WO | WO 2000/050462 | 8/2000 |
| WO | WO 2000/050463 | 8/2000 |
| WO | WO 2000/065145 | 11/2000 |
| WO | WO 2001/029309 | 4/2001 |
| WO | WO 2001/034656 | 5/2001 |
| WO | WO 2001/034657 | 5/2001 |
| WO | WO 2001/083887 | 11/2001 |
| WO | WO 2001/088236 | 11/2001 |
| WO | WO 2002/048196 | 6/2002 |
| WO | WO 2002/048197 | 6/2002 |
| WO | WO 2002/049565 | 6/2002 |
| WO | WO 2002/086206 | 10/2002 |
| WO | WO 2002/088289 | 11/2002 |
| WO | WO 2003/006739 | 1/2003 |
| WO | WO 03/042451 | 5/2003 |
| WO | WO 2004/062703 | 7/2004 |
| WO | WO 2005/028744 | 3/2005 |
| WO | WO 2005/058972 | 6/2005 |
| WO | WO 2005/068074 | 7/2005 |
| WO | WO 2006/102543 | 9/2006 |
| WO | WO 2006/119392 | 11/2006 |
| WO | WO 2006/125517 | 11/2006 |
| WO | WO 2007/042192 | 4/2007 |
| WO | WO 2007/090461 | 8/2007 |
| WO | WO 2008/010187 | 1/2008 |
| WO | WO 2008/098037 | 8/2008 |
| WO | WO 2008/153565 | 12/2008 |
| WO | WO 2008/154073 | 12/2008 |
| WO | WO 2009/134746 | 11/2009 |
| WO | WO 2010/025224 | 3/2010 |
| WO | WO 2010/138941 | 12/2010 |
| WO | WO 2011/002956 | 1/2011 |
| WO | WO 2011/088889 | 7/2011 |
| WO | WO 2011/089123 | 7/2011 |
| WO | WO 2011/090425 | 7/2011 |
| WO | WO 2012/170183 | 12/2012 |
| WO | WO 2013/158384 | 10/2013 |
| WO | WO 2013/106703 | 7/2017 |

OTHER PUBLICATIONS

Burgess, "Relationships Between Colour Production in Cellulose and the Chemical Changes Brought About by Bleaching," Transcript of a Lecture given at the Meeting of the Book and Paper Specialty Group, AIC Annual Meeting, Milwaukee, May 27-30, 1982 (http://cool.conversation-us.org/coolaic/sg/bpg/annual/v01/bp01-05.html).

Dang et al., "Alkaline peroxide treatment of ECF bleached softwood kraft pulps. Part 1. Characterizing the effect of alkaline peroxide treatment on carboxyl groups of fibers," Holzforschung,vol. 61, pp. 445-450, 2007.

Dang, "The Investigation of Carboxyl Groups of Pulp Fibers During Kraft Pulping, Alkaline Peroxide Bleaching, and TEMPO-mediated Oxication,"Georgia Insitute of Technology, Aug. 2007.

Easty et al., "Estimation of Pulp Yield in Continuous Digesters from Carbohydrate and Lignin Determinations," TAPPI Journal 65(12):78-80 (1982).

Edwards et al., "Research and Development of Active Cotton Wound Dressings," 2004 Belwide Cotton Conferences, San Antonio, TX.

ESM055B01, Econotech Aldehyde Test, referenced in U.S. Appl. No. 61/182,000, filed May 28, 2009.

fibersource.com, "Cellulose," [retrieved Sep. 12, 2013 from http://www.fibersource.com/F-tutor/cellulose.htm], 5 pages.

Filho et al., "Hydrogen Peroxide in Chemical Pulp Bleaching—an overview," 2002 Congreso Iberoamericano de Invesigacion en cellulosa y Papel, CIADICYP, pp. 1-27.

Georgia-Pacific West, Permit Renewal Response to Comments, 2001.

Gullichsen et al., Chemical Pulping 6A, 1999, Fapet Oy, pp. A207 and A653.

Gullichsen, "Chemical Pulping," Papermaking Science and Technology, Book 6A, pp. A635-A665, 1992.

International Paper, http://web.archive.org/web/20051107013141/hhtp://www.internationalpaper.com/Paper/Paper%20Products/Pulp/Southern_Bleached_So.html, Nov. 7, 2005.

Kennedy et al., The Chemistry and Processing of Wood and Plant Fibrous Materials, p. 155, Woodhead Publishing Ltd, Abington Hall, Abington, Cambridge CBI 6AH, England, 1996.

Kirk, T.K., et al. Characteristics of Cotton Cellulose Depolymerized by a Brown-Rot Fungus, by Acid, or by Chemical Oxidants, Holzforschung, vol. 45, No. 4 (1991) pp. 239-244.

Kubelka et al., "Delignification with Acidic Hydrogen Peroxide Activated by Molybdate," Journal of Pulp and Paper Science: vol. 18, No. 3, May 1992, pp. J108-J114.

Lapierre et al., "The Effect of Magnesium Ions and Chelants on Peroxide Bleaching," Holzforschung, vol. 57, No. 6, pp. 627-633, 2003.

Lenntech BV, http:/www.lentech.com/Fenton-reaction.htm [downloaded from www.archive.org], Jun. 28, 2003 [retrieved Sep. 12, 2013], whole document.

Morton, J.H., The Chemistry and Processing of Wood and Plant Fibrous Materials, Woodhead Publishing Ltd. (1996), pp. 151-158.

Norden, Solveig et al., "Bleaching of Extremely Low Kappa Southern Pine, Cooked by the Superbatch™ Process," 1992 Pulping Conference, TAPPI Proceedings, 1992 Pulping Conference, pp. 159-168.

Qian et al., Journal of Wood Chemistry and Technology (2002), vol. 22, No. 4, pp. 267-284.

Qian, "The Chemical Mechanism of a Brown-Rot Decay Mimtic System and its Applicationi n paper Recycling Processes," [Chapter 4: The Effects of Chelator Mediated Fenton System on the Fiber and Paper Properties of Hardwood Kraft Pulp], 2001, *Electronic Theses and Dissertations*, Paper 505.

Ragauskas, Copper Number—Carbonyl Content of Pulp Fibers, document date "created" identified as May 12, 2007.

Rahmawati et al., "Pulp bleaching by hydrogen peroxide activated with copper 2,2_-dipyridylamine and 4-aminopyridine complexes," 2005, Chemical Engineering Journal, vol. 112, pp. 167-171.

(56) References Cited

OTHER PUBLICATIONS

Rapson, W. Howard and Irving H. Spinner, Chapter 14 in the Bleaching of Pulp (1963).
Rohrling et al., "A novel method for the determination of carbonyl groups in cellulosics by fluorescence labeling. 2. Validation and applications," Biomacromolecules Sep.-Oct. 2002; 3(5): 969-975.
Ruuttunen et al., "Concomitant Usage of Transition Metal Polyanions as Catalysts in Oxygen Delignification: Laboratory Bleaching Trials," 2006, Appita Journal, pp. 1-14.
Shenai, "Studies in Chemically Modified Celluloses. IX. Oxidation of Cellulose in the Presence of Chelating Agents," 1976, Journal of Applied Polymer Science, vol. 20, pp. 385-391.
Sixta Editor, Handbook of Pulp, 2006, "Batch Cooking versus Continuous Cooking," p. 366-509.
Smook, Handbook for Pulp and Paper Technologists, 1992, Angus Wilde Publications, 2nd edition, Chapter 16, pp. 228-263.
Smook, Handbook for Pulp Paper Technologist, 1992, Angus Wilde Publications, 2nd Edition, Chapter 13, pp. 194-208.
Smook, Handbook of Pulp & Paper Terminology, 1990, pp. 89-90.
Song et al., Novel antiviral activity of dialdehyde starch, Electronic J. Biotech., vol. 12, No. 2, 2009.
Suchy et al., "Catalysis and Activation of Oxygen and Peroxide Delignification of Chemical Pulps; A Review," Miscellaneous Report, Pulp and Paper Research Institute of Canada, 1999, pp. 1-32.
Sun et al., "The effect of metal ions on the reaction of hydrogen peroxide with Kraft lignin model compounds" 1999, Can. J. Chem, vol. 77 (pp. 667-675).
TAPPI, T-525 om-92, Diffuse Brightness of Pulp 1992.
Wojciak et al., "Direct Characterization of Hydrogen Peroxide Bleached Thermomechanial Pulp Using Spectroscopic Methods," J. Phys. Chem. A., vol. 111, pp. 10530-10536, 2007.
Zeronian et al., "Bleaching of cellulose by hydrogen peroxide," Cellulose, 1995, pp. 265-272.
English-language abstract for JPH08158284A published Jun. 18, 1996.
International Search Report dated Aug. 5, 2014 in corresponding Application No. PCT/IB2014/000680.

* cited by examiner

SOFTWOOD KRAFT FIBER HAVING AN IMPROVED α-CELLULOSE CONTENT AND ITS USE IN THE PRODUCTION OF CHEMICAL CELLULOSE PRODUCTS

CROSS REFERENCE TO RELATED APPLICATIONS

This application is a national phase application based on PCT/IB2014/000680, filed Feb. 6, 2014, which claims the benefit of U.S. Provisional Application Nos. 61/762,532, filed Feb. 8, 2013; 61/782,035, filed Mar. 14, 2013; and 61/789,610, filed Mar. 15, 2013, the contents of all of which are incorporated herein by reference.

TECHNICAL FIELD

This disclosure relates to modified kraft fiber having improved α-cellulose content. This disclosure further relates to softwood, more particularly southern pine, kraft fiber having excellent whiteness and brightness, as well as an improved α-cellulose content. More particularly, this disclosure relates to softwood fiber, e.g., southern pine fiber, that exhibits a low viscosity, for example, less than 6.5 mPa·s and high α-cellulose content, for example, an R18 value of at least 87.5%, improving its performance over other cellulose fiber derived from kraft pulp and making it useful in applications that have heretofore been limited to expensive fibers (e.g., cotton or high alpha content sulfite pulp.

This disclosure also relates to methods for producing the improved fiber described. Finally, this disclosure relates to products produced using the improved fiber as described.

Cellulose fiber and derivatives are widely used in paper, absorbent products, food or food-related applications, pharmaceuticals, and in industrial applications. The main sources of cellulose fiber are wood pulp and cotton. The cellulose source and the cellulose processing conditions generally dictate the cellulose fiber characteristics, and therefore, the fiber's applicability for certain end uses. A need exists for cellulose fiber that is relatively inexpensive to process, yet contains more α-cellulose and fewer impurities and is highly versatile, enabling its use in a variety of applications. Specifically, there is a need for a lower cost kraft fiber than can be more readily substituted in higher quantities for more expensive fiber in the production of cellulose derivatives, e.g., viscose.

Kraft fiber, produced by a chemical kraft pulping method, provides an inexpensive source of cellulose fiber that generally provides final products with good brightness and strength characteristics. As such, it is widely used in paper applications. However, standard kraft fiber has limited applicability in downstream applications, such as cellulose derivative production, due to the chemical structure of the cellulose resulting from traditional kraft pulping and bleaching. In general, traditional kraft fiber contains too much residual hemi-cellulose and other naturally occurring materials that may interfere with the subsequent physical and/or chemical modification of the fiber. Moreover, traditional kraft fiber has limited chemical functionality, and is generally rigid and not highly compressible.

In the typical kraft process a chemical reagent referred to as "white liquor" is combined with wood chips in a digester to carry out delignification. Delignification refers to the process whereby lignin bound to the cellulose fiber is removed due to its high solubility in hot alkaline solution. This process is often referred to as "cooking." Typically, the white liquor is an alkaline aqueous solution of sodium hydroxide (NaOH) and sodium sulfide ($Na_2S$). Depending upon the wood species used and the desired end product, white liquor is added to the wood chips in sufficient quantity to provide a desired total alkali charge based on the dried weight of the wood.

Generally, the temperature of the wood/liquor mixture in the digester is maintained at about 145° C. to 170° C. for a total reaction time of about 1-3 hours. When digestion is complete the resulting kraft wood pulp is separated from the spent liquor (black liquor) which includes the used chemicals and dissolved lignin. Conventionally, the black liquor is burnt in a kraft recovery process to recover the sodium and sulphur chemicals for reuse.

At this stage, the kraft pulp exhibits a characteristic brownish color due to lignin residues that remain on the cellulose fiber. Following digestion and washing, the fiber is often bleached to remove additional lignin and whiten and brighten the fiber. Because bleaching chemicals are much more expensive than cooking chemicals, typically, as much lignin as possible is removed during the cooking process. However, it is understood that these processes need to be balanced because removing too much lignin can increase cellulose degradation. The typical Kappa number (the measure used to determine the amount of residual lignin in pulp) of softwood in a standard process after cooking and prior to bleaching is in the range of 28 to 32.

Following digestion and washing, the fiber is generally bleached in multi-stage sequences, which traditionally comprise strongly acidic and strongly alkaline bleaching steps, including at least one alkaline step at or near the end of the bleaching sequence. Bleaching of wood pulp is generally conducted with the aim of selectively increasing the whiteness or brightness of the pulp, typically by removing lignin and other impurities, without negatively affecting physical properties. Bleaching of chemical pulps, such as kraft pulps, generally requires several different bleaching stages to achieve a desired brightness with good selectivity. Typically, a bleaching sequence employs stages conducted at alternating pH ranges. This alternating aids in the removal of impurities generated in the bleaching sequence, for example, by solubilizing the products of lignin breakdown. Thus, in general, it is expected that using a series of acidic stages in a bleaching sequence, such as three acidic stages in sequence, would not provide the same brightness as alternating acidic/alkaline stages, such as acidic-alkaline-acidic. For instance, a typical DEDED sequence produces a brighter product than a DEDAD sequence (where A refers to an acid treatment).

Cellulose exists generally as a polymer chain comprising hundreds to tens of thousands of glucose units. Cellulose may be oxidized to modify its functionality. Various methods of oxidizing cellulose are known. In cellulose oxidation, hydroxyl groups of the glycosides of the cellulose chains can be converted, for example, to carbonyl groups such as aldehyde groups, ketone groups or carboxylic acid groups. Depending on the oxidation method and conditions used, the type, degree, and location of the carbonyl modifications may vary. It is known that certain oxidation conditions may degrade the cellulose chains themselves, for example by cleaving the glycosidic rings in the cellulose chain, resulting in depolymerization. In most instances, depolymerized cellulose not only has a reduced viscosity, but also has a shorter fiber length than the starting cellulosic material. When cellulose is degraded, such as by depolymerizing and/or significantly reducing the fiber length and/or the fiber strength, it may be difficult to process and/or may be unsuitable for many downstream applications. A need remains for methods of modifying cellulose fiber that may improve carboxylic acid, aldehyde and ketone functionalities, which methods do not extensively degrade the cellulose fiber.

Various attempts have been made to oxidize cellulose to provide both carboxylic and aldehydic functionality to the cellulose chain without degrading the cellulose fiber. In many cellulose oxidation methods, it has been difficult to control or limit the degradation of the cellulose when aldehyde groups are present on the cellulose. Previous attempts at resolving these issues have included the use of multi-step oxidation processes, for instance site-specifically modifying certain carbonyl groups in one step and oxidizing other hydroxyl groups in another step, and/or providing mediating agents and/or protecting agents, all of which may impart extra cost and by-products to a cellulose oxidation process. Thus, there exists a need for methods of modifying cellulose that are cost effective and/or can be performed in a single step of a process, such as a kraft process.

In addition to the difficulties in controlling the chemical structure of cellulose oxidation products, and the degradation of those products, it is known that the method of oxidation may affect other properties, including chemical and physical properties and/or impurities in the final products. For instance, the method of oxidation may affect the degree of crystallinity, the hemi-cellulose content, the color, and/or the levels of impurities in the final product and the yellowing characteristics of the fiber. Ultimately, the method of oxidation may impact the ability to process the cellulose product for industrial or other applications.

Traditionally, cellulose sources that were useful in the production of absorbent products or tissue were not also useful in the production of downstream cellulose derivatives, such as cellulose ethers and cellulose esters. The production of low viscosity cellulose derivatives from high viscosity cellulose raw materials, such as traditional kraft fiber, requires additional manufacturing steps that would add significant cost while imparting unwanted by-products and reducing the overall quality of the cellulose derivative. Cotton linter and high α-cellulose content sulfite pulps, which generally have a high degree of polymerization, are typically used in the manufacture of cellulose derivatives, such as cellulose ethers and esters. However, production of cotton linters and sulfite fiber with a high degree of polymerization (DP) and/or viscosity is expensive due to 1) the cost of the starting material, in the case of cotton; 2) the high energy, chemical, and environmental costs of pulping and bleaching, in the case of sulfite pulps; and 3) the extensive purifying processes required, which applies in both cases. In addition to the high cost, there is a dwindling supply of sulfite pulps available to the market. Therefore, these fibers are very expensive, and have limited applicability in pulp and paper applications, for example, where higher purity or higher viscosity pulps may be required. For cellulose derivative manufacturers these pulps constitute a significant portion of their overall manufacturing cost. Thus, there exists a need for high α-cellulose-content, high purity, white, bright, readily available and low-cost fibers, such as a kraft fiber, that may be used in the production of cellulose derivatives. More specifically, there is a need for a fiber that can replace a higher percentage of the expensive fibers that are currently required to make cellulose derivatives.

There is also a need for inexpensive cellulose materials that can be used in the manufacture of microcrystalline cellulose. Microcrystalline cellulose is widely used in food, pharmaceutical, cosmetic, and industrial applications, and is a purified crystalline form of partially depolymerized cellulose. The use of kraft fiber in microcrystalline cellulose production, without the addition of extensive post-bleaching processing steps, has heretofore been limited. Microcrystalline cellulose production generally requires a highly purified cellulosic starting material, which is acid hydrolyzed to remove amorphous segments of the cellulose chain. See U.S. Pat. No. 2,978,446 to Battista et al. and U.S. Pat. No. 5,346,589 to Braunstein et al. A low degree of polymerization of the chains upon removal of the amorphous segments of cellulose, termed the "level-off DP," is frequently a starting point for microcrystalline cellulose production and its numerical value depends primarily on the source and the processing of the cellulose fibers. The dissolution of the non-crystalline segments from standard kraft fiber generally degrades the fiber to an extent that renders it unsuitable for most applications because of at least one of 1) remaining impurities; 2) a lack of sufficiently long crystalline segments; or 3) it results in a cellulose fiber having too high a degree of polymerization, typically in the range of 200 to 400, to make it useful in the production of microcrystalline cellulose. Kraft fiber having an increased α-cellulose content, for example, would be desirable, as the kraft fiber may provide greater versatility in microcrystalline cellulose production and applications.

In the present disclosure, fiber having one or more of the described properties can be produced simply through modification of a kraft pulping plus bleaching process. Fiber of the present disclosure overcomes many of the limitations associated with traditional kraft fiber discussed herein and provides an increased α-cellulose content when compared with fiber produced by prior oxidative bleaching sequences. In addition, pulp of the present invention having improved properties can more easily be incorporated into expensive fiber pulp used in the production of chemical cellulose, e.g., viscose. This surfactant treatment improves incorporation allowing more kraft based fiber to be substituted for the expensive cotton linter and sulfite pulps.

The methods of the present disclosure result in products that have characteristics that are very surprising and contrary to those predicted based on the teachings of the prior art. Thus, the methods of the disclosure may provide products that are superior to the products of the prior art and can be more cost-effectively produced.

DESCRIPTION

I. Methods

The present disclosure provides novel methods for producing cellulose fiber. The method comprises subjecting cellulose to a kraft pulping step, an oxygen delignification step, and a bleaching sequence. Similar pulping and bleaching processes are disclosed in published International Application No. WO 2010/138941, which is incorporated by reference in its entirety. Fiber produced under the conditions as described in the instant application exhibits the same high whiteness and high brightness while having an improved α-cellulose content and lower viscosity than the fiber described in published International Application Serial No. WO 2010/138941.

The cellulose fiber used in the methods described herein may be derived from softwood fiber, hardwood fiber, and mixtures thereof. In some embodiments, the modified cellulose fiber is derived from softwood, from any known source, including but not limited to, pine, spruce and fir. In some embodiments, the modified cellulose fiber is derived from hardwood, such as eucalyptus. In some embodiments, the modified cellulose fiber is derived from a mixture of softwood and hardwood. In yet another embodiment, the modified cellulose fiber is derived from cellulose fiber that has previously been subjected to all or part of a kraft process, i.e., kraft fiber.

References in this disclosure to "cellulose fiber" or "kraft fiber" are interchangeable except where specifically indicated as different or where one of ordinary skill in the art would understand them to be different. As used herein "modified kraft fiber," or "oxidized kraft fiber" refers to fiber which has been cooked, bleached and oxidized in accordance with the present disclosure may be used interchangeably with "kraft fiber" or "pulp fiber" to the extent that the context warrants it.

References in this disclosure to "bleaching step," and "bleaching stage" are interchangeable and refer to each chemically divergent operation in a multistage bleaching sequence.

The present disclosure provides novel methods for treating cellulose fiber. In some embodiments, the disclosure provides a method of modifying cellulose fiber, comprising providing cellulose fiber, and oxidizing the cellulose fiber. As used herein, "oxidized," "catalytically oxidized," "catalytic oxidation" and "oxidation" are all understood to be interchangeable and refer to treatment of cellulose fiber with at least one metal catalyst, such as iron or copper and at least one peroxide, such as hydrogen peroxide, such that at least some of the hydroxyl groups of the cellulose fibers are oxidized. The phrase "iron or copper" and similarly "iron (or copper)" mean "iron or copper or a combination thereof." In some embodiments, the oxidation comprises simultaneously increasing carboxylic acid and aldehyde content of the cellulose fiber.

In one method of the invention, cellulose, preferably southern pine, is digested in a two-vessel hydraulic digester with, Lo-Solids™ cooking to a kappa number ranging from about 10 to about 16. The resulting pulp is subjected to oxygen delignification until it reaches a kappa number of about 6.5 or below. Finally, the cellulose pulp is bleached in a multi-stage bleaching sequence until it reaches an appropriate ISO brightness. In some embodiments, the ISO brightness can be as high at 91.

In one embodiment, the method comprises digesting the cellulose fiber in a continuous digester with a co-current, down-flow arrangement. The effective alkali of the white liquor charge is at least about 17.5%, for example at least about 18%, for example, at least about 18.5%, for example at least about 18.7%. In one embodiment, the white liquor charge is divided with a portion of the white liquor being applied to the cellulose in the impregnator and the remainder of the white liquor being applied to the pulp in the digester. According to one embodiment, the white liquor is applied in a 50:50 ratio. In another embodiment, the white liquor is applied in a range of from 90:10 to 30:70, for example in a range from 50:50 to 70:30, for example 60:40. According to one embodiment, the white liquor is added to the digester in a series of stages. According to one embodiment, digestion is carried out at a temperature between about 320° F. to about 335° F., for example, from about 325° F. to about 330° F., for example, from about 326° F. to about 329° F., and the cellulose is treated until a target kappa number between about 13 and about 16 is reached. The higher than normal effective alkali ("EA") and higher temperature achieved the lower than normal Kappa number.

According to one embodiment of the invention, the digester is run with an increase in push flow which essentially increases the liquid to wood ratio as the cellulose enters the digester. This addition of white liquor assists in maintaining the digester at a hydraulic equilibrium and assists in achieving a continuous down-flow condition in the digester.

In one embodiment, the method comprises oxygen delignifying the cellulose fiber after it has been cooked in the digester to a kappa number of about 13 to about 16 to further reduce the lignin content and further reduce the kappa number, prior to bleaching. Oxygen delignification can be performed by any method known to those of ordinary skill in the art. For instance, oxygen delignification may be a conventional two-stage oxygen delignification. Advantageously, the delignification is carried out to a target kappa number of less than about 6.5, for example less than about 6, for example less than about 5.8.

In one embodiment, during oxygen delignification the applied oxygen is less than about 2%, for example, less than about 1.8%, for example, less than about 1.6%, for example less than about 1.5%. According to one embodiment, fresh caustic is added to the cellulose during oxygen delignification. Fresh caustic may be added in an amount of from about 2% to about 3.8%, for example, from about 2.5% to about 3.0%. According to one embodiment, the ratio of oxygen to caustic is reduced over standard kraft production, however the absolute amount of oxygen remains the same. Delignification was carried out at a temperature of from about 190° F. to about 210° F., for example, from about 195° F. to about 205° F., for example, from about 198° F. to about 202° F.

After the fiber has reaches a Kappa Number of about 6.5 or less, the fiber is subjected to a four- or five-stage bleaching sequence. The stages of the multi-stage bleaching sequence may include any conventional or after discovered series of stages and may be conducted under conventional conditions provided that at least one oxidation stage is followed by both at least one chlorine dioxide stage and at least one alkaline stage.

In some embodiments, prior to bleaching the pH of the cellulose is adjusted to a pH ranging from about 2 to about 6, for example from about 2 to about 5 or from about 2 to about 4, or from about 2 to about 3.

The pH can be adjusted using any suitable acid, as a person of skill would recognize, for example, sulfuric acid or hydrochloric acid or filtrate from an acidic bleach stage of a bleaching process, such as a chlorine dioxide (D) stage of a multi-stage bleaching process. For example, the cellulose fiber may be acidified by adding an extraneous acid. Examples of extraneous acids are known in the art and include, but are not limited to, sulfuric acid, hydrochloric acid, and carbonic acid. In some embodiments, the cellulose fiber is acidified with acidic filtrate, such as waste filtrate, from a bleaching step. In at least one embodiment, the cellulose fiber is acidified with acidic filtrate from a D stage of a multi-stage bleaching process.

The fiber, described, is subjected to a catalytic oxidation treatment. In some embodiments, the fiber is oxidized with iron or copper and then further bleached to provide a fiber with beneficial α-cellulose content, viscosity and brightness characteristics.

In accordance with the disclosure, oxidation of cellulose fiber involves treating the cellulose fiber with at least a catalytic amount of a metal catalyst, such as iron or copper and a peroxygen, such as hydrogen peroxide. In at least one embodiment, the method comprises oxidizing cellulose fiber with iron and hydrogen peroxide. The source of iron can be any suitable source, as a person of skill would recognize, such as for example ferrous sulfate (for example ferrous sulfate heptahydrate), ferrous chloride, ferrous ammonium sulfate, ferric chloride, ferric ammonium sulfate, or ferric ammonium citrate.

In some embodiments, the method comprises oxidizing the cellulose fiber with copper and hydrogen peroxide. Similarly, the source of copper can be any suitable source as a person of skill would recognize. Finally, in some embodiments, the method comprises oxidizing the cellulose fiber with a combination of copper and iron and hydrogen peroxide.

When cellulose fiber is being oxidized in a bleaching step, it should not be subjected to substantially alkaline conditions during the oxidation. The method comprises oxidizing cellulose fiber at an acidic pH. In some embodiments, the method comprises providing cellulose fiber, acidifying the cellulose fiber, and then oxidizing the cellulose fiber at acidic pH. In some embodiments, the pH ranges from about 2 to about 6, for example from about 2 to about 5 or from about 2 to about 4.

In some embodiments, the method comprises oxidizing the cellulose fiber in one or more stages of a multi-stage bleaching sequence. In some embodiments, the method comprises oxidizing the cellulose fiber in a single stage of a multi-stage bleaching sequence. In some embodiments, the method comprises oxidizing the cellulose fiber at or near the beginning of a multi-stage bleaching sequence. In some embodiments, the method comprises at least one alkaline stage and at least one bleaching stage following the oxidation step. In some embodiments, the method comprises oxidizing cellulose fiber in the second stage of a five-stage bleaching sequence.

In accordance with the disclosure, the multi-stage bleaching sequence can be any bleaching sequence that includes both an alkaline bleaching step and a chlorine dioxide stage following the oxidation step. In at least one embodiment, the multi-stage bleaching sequence is a five-stage bleaching sequence. In some embodiments, the bleaching sequence is a DEDED sequence. In some embodiments, the bleaching sequence is a $D_0$E1D1E2D2 sequence. The non-oxidation stages of a multi-stage bleaching sequence may include any conventional or after discovered series of stages, and can be conducted under conventional conditions.

In some embodiments, the oxidation is incorporated into the second stage of a multi-stage bleaching process. In some embodiments, the method is implemented in a five-stage bleaching process having a sequence of $D_0$E1D1E2D2, and the second stage (E1) is used for oxidizing kraft fiber.

In at least one embodiment, the oxidation occurs in a single stage of a bleaching sequence after both the iron or copper and peroxide have been added and some retention time provided. An appropriate retention is an amount of time that is sufficient to catalyze the hydrogen peroxide with the iron or copper. Such time will be easily ascertainable by a person of ordinary skill in the art.

In accordance with the disclosure, the oxidation is carried out for a time and at a temperature that is sufficient to produce the desired completion of the reaction. For example, the oxidation may be carried out at a temperature ranging from about 75 to about 88° C., and for a time ranging from about 40 to about 80 minutes. The desired time and temperature of the oxidation reaction will be readily ascertainable by a person of skill in the art.

In some embodiments, the kappa number increases after oxidation of the cellulose fiber. More specifically, one would typically expect a decrease in kappa number across this bleaching stage based upon the anticipated decrease in material, such as lignin, which reacts with the permanganate reagent. However, in the method as described herein, the kappa number of cellulose fiber may decrease because of the loss of impurities, e.g., lignin; however, the kappa number may increase because of the chemical modification of the fiber. Not wishing to be bound by theory, it is believed that the increased functionality of the modified cellulose provides additional sites that can react with the permanganate reagent. Accordingly, the kappa number of modified kraft fiber could be elevated relative to the kappa number of standard kraft fiber. According to one embodiment, the kappa number after the oxidation is less than 2.5, for example, less than 2.3, for example, about 2.1.

According to one embodiment, the cellulose is subjected to a DE1 DE2D bleaching sequence. According to this embodiment, the first D stage ($D_0$) of the bleaching sequence is carried out at a temperature of at least about 57° C., for example at least about 60° C., for example, at least about 66° C., for example, at least about 71° C. and at an acidic pH. Chlorine dioxide is applied in an amount of greater than about 0.6% on pulp, for example, greater than about 0.65% on pulp, for example about 0.7% on pulp or higher, for example, about 0.7% on pulp. Acid is applied to the cellulose in an amount sufficient to maintain the pH, for example, in an amount of at least about 1% on pulp, for example, at least about 1.15% on pulp, for example, at least about 1.25% on pulp. According to one embodiment, the pH at the end of the $D_0$ stage is less than about 3, for example about 2.5.

According to one embodiment, the first E1 stage ($E_1$), an oxidation stage, is carried out at a temperature of at least about 75° C., for example at least about 80° C., for example, at least about 82° C. and at a pH of less than about 3.5, for example, less than 3.0, for example, less than about 2.8. An iron catalyst is added in, for example, aqueous solution at a rate of from about 25 to about 50 ppm $Fe^{+2}$, for example, from 25 to 40 ppm, for example, from 25 to 35 ppm, iron on pulp. Hydrogen Peroxide is applied to the cellulose in an amount of less than about 0.5% on pulp, for example, less than about 0.3% on pulp, for example, about 0.25% on pulp. The skilled artisan would recognize that any known peroxygen compound could be used to replace some or all of the hydrogen peroxide.

In accordance with the disclosure, hydrogen peroxide is added to the cellulose fiber in acidic media in an amount sufficient to achieve the desired oxidation and/or degree of polymerization and/or viscosity of the final cellulose product. For example, peroxide can be added as a solution at a concentration from about 1% to about 50% by weight in an amount of from about 0.1 to about 0.5%, or from about 0.1% to about 0.3%, or from about 0.1% to about 0.2%, or from about 0.2% to about 0.3%, based on the dry weight of the pulp.

Iron or copper are added at least in an amount sufficient to catalyze the oxidation of the cellulose with peroxide. For example, iron can be added in an amount ranging from about 25 to about 75 ppm based on the dry weight of the kraft pulp, for example, from 25 to 50 ppm, for example, from 25 to 40 ppm. A person of skill in the art will be able to readily optimize the amount of iron or copper to achieve the desired level or amount of oxidation.

According to one embodiment of the invention, the kappa number after the D(E1) stage is about 2.2 or less, for example about 2.1. According to one embodiment, the viscosity after the oxidation stage is 5.0 to 7.0, for example, 5.5 to 6.5, for example, 5.7 to 6.5, for example less than 6.0 mPa·s.

In some embodiments, the final DP and/or viscosity of the pulp can be controlled by the amount of iron or copper and hydrogen peroxide and the robustness of the bleaching conditions prior to the oxidation step. A person of skill in the art will recognize that other properties of the modified kraft fiber of the disclosure may be affected by the amounts of catalyst and peroxide and the robustness of the bleaching conditions prior to the oxidation step. For example, a person of skill in the art may adjust the amounts of iron or copper and hydrogen peroxide and the robustness of the bleaching conditions prior to the oxidation step to target or achieve a desired brightness in the final product and/or a desired degree of polymerization or viscosity.

In some embodiments, a kraft pulp is acidified on a $D_0$ stage washer, the iron source (or copper source) is also added to the kraft pulp on the $D_0$ stage washer, the peroxide is added following the iron source (or copper source) at an addition point in the mixer or pump before the E1 stage tower, the kraft pulp is reacted in the E1 tower and washed on the E1 washer, and heat, for example in the form of steam may optionally be added before the E1 tower in a steam mixer.

In some embodiments, iron (or copper) can be added up until the end of the $D_0$ stage, or the iron (or copper) can also be added at the beginning of the E1 stage, provided that the pulp is acidified first (i.e., prior to addition of the iron (or copper)) at the $D_0$ stage. Heat, for example, steam may be optionally added either before or after the addition of the peroxide.

For example, in some embodiments, the treatment with hydrogen peroxide in an acidic media with iron (or copper) may involve adjusting the pH of the kraft pulp to a pH ranging from about 2 to about 5, adding a source of iron (or copper) to the acidified pulp, and adding hydrogen peroxide to the kraft pulp.

According to one embodiment, the second D stage ($D_1$) of the bleaching sequence is carried out at a temperature of at least about 75° C., for example at least about 77° C., for example, at least about 79° C., for example, at least about 82° C. and at a pH of less than about 4, for example less than 3.5, for example less than 3.0. Chlorine dioxide is applied in an amount of less than about 1% on pulp, for example, less than about 0.9% on pulp, for example about 0.9% on pulp. Caustic is applied to the cellulose in an amount effective to adjust to the desired pH, for example, in an amount of less than about 0.015% on pulp, for example, less than about 0.01% pulp, for example, about 0.0075% on pulp. The TAPPI viscosity of the pulp after this bleaching stage may be 5-6.5 mPa·s, for example.

According to one embodiment, the second E stage ($E_2$), is carried out at a temperature of at least about 74° C., for example at least about 77° C., for example at least about 79° C., for example at least about 82° C., and at a pH of greater than about 11, for example, greater than 11.2, for example about 11.4. Caustic is applied in an amount of greater than about 0.7% on pulp, for example, greater than about 0.8% on pulp, for example greater than about 1.0% on pulp, for example, greater than 1.2% on pulp. Hydrogen Peroxide is applied to the cellulose in an amount of at least about 0.25% on pulp, for example at least about 0.28% on pulp, for example, about 3.0% on pulp. The skilled artisan would recognize that any known peroxygen compound could be used to replace some or all of the hydrogen peroxide In some embodiments, the method further involves adding heat, such as through steam, either before or after the addition of hydrogen peroxide.

According to one embodiment, the third D stage ($D_2$) of the bleaching sequence is carried out at a temperature of at least about 74° C., for example at least about 77° C., for example, at least about 79° C., for example, at least about 82° C. and at a pH of less than about 5, for example, less than about 4.5, for example, about 4.4. Chlorine dioxide is applied in an amount of less than about 0.5% on pulp, for example, less than about 0.3% on pulp, for example, less than about 0.15% on pulp, for example, about 0.14% on pulp.

Alternatively, the multi-stage bleaching sequence may be altered to provide more robust bleaching conditions prior to oxidizing the cellulose fiber. In some embodiments, the method comprises providing more robust bleaching conditions prior to the oxidation step. More robust bleaching conditions may allow the degree of polymerization and/or viscosity of the cellulose fiber to be reduced in the oxidation step with lesser amounts of iron or copper and/or hydrogen peroxide. Thus, it may be possible to modify the bleaching sequence conditions so that the brightness and/or viscosity of the final cellulose product can be further controlled. For instance, reducing the amounts of peroxide and metal, while providing more robust bleaching conditions before oxidation, may provide a product with lower viscosity and higher brightness than an oxidized product produced with identical oxidation conditions but with less robust bleaching. Such conditions may be advantageous in some embodiments, particularly in cellulose ether applications.

In some embodiments, for example, the method of preparing a cellulose fiber within the scope of the disclosure may involve acidifying the kraft pulp to a pH ranging from about 2 to about 5 (using for example sulfuric acid), mixing a source of iron (for example ferrous sulfate, for example ferrous sulfate heptahydrate) with the acidified kraft pulp at an application of from about 25 to about 250 ppm $Fe^{+2}$ based on the dry weight of the kraft pulp at a consistency ranging from about 1% to about 15% and also hydrogen peroxide, which can be added as a solution at a concentration of from about 1% to about 50% by weight and in an amount ranging from about 0.1% to about 1.5% based on the dry weight of the kraft pulp. In some embodiments, the ferrous sulfate solution is mixed with the kraft pulp at a consistency ranging from about 7% to about 15%. In some embodiments the acidic kraft pulp is mixed with the iron source and reacted with the hydrogen peroxide for a time period ranging from about 40 to about 80 minutes at a temperature ranging from about 60 to about 80° C.

In some embodiments, each stage of the five-stage bleaching process includes at least a mixer, a reactor, and a washer (as is known to those of skill in the art).

In at least one embodiment, the method comprises providing cellulose fiber, partially bleaching the cellulose fiber, and oxidizing the cellulose fiber. In some embodiments, the oxidation is conducted in the second stage of a five stage bleaching process. In at least one embodiment, oxidation of carried out in a sequence in which both an alkaline and a chlorine dioxide stage follow the oxidation stage.

Fiber produced as described may, in some embodiments, be treated with a surface active agent. The surface active agent for use in the present invention may be solid or liquid. The surface active agent can be any surface active agent, including by not limited to softeners, debonders, and surfactants that is not substantive to the fiber, i.e., which does not interfere with its specific absorption rate. As used herein a surface active agent that is "not substantive" to the fiber exhibits an increase in specific absorption rate of 30% or less as measured using the pfi test as described herein. According to one embodiment, the specific absorption rate is increased by 25% or less, such as 20% or less, such as 15% or less, such as 10% or less. Not wishing to be bound by theory, the addition of surfactant causes competition for the same sites on the cellulose as the test fluid. Thus, when a surfactant is too substantive, it reacts at too many sites reducing the absorption capability of the fiber.

As used herein PFI is measured according to SCAN-C-33:80 Test Standard, Scandinavian Pulp, Paper and Board Testing Committee. The method is generally as follows. First, the sample is prepared using a PFI Pad Former. Turn on the vacuum and feed approximately 3.01 g fluff pulp into the pad former inlet. Turn off the vacuum, remove the test piece and place it on a balance to check the pad mass. Adjust the fluff mass to 3.00±0.01 g and record as $Mass_{dry}$. Place the fluff into the test cylinder. Place the fluff containing cylinder in the shallow perforated dish of an Absorption Tester and turn the water valve on. Gently apply a 500 g load to the fluff pad while lifting the test piece cylinder and promptly press the start button. The Tester will fun for 30 s before the display will read 00.00. When the display reads 20 seconds, record the dry pad height to the nearest 0.5 mm ($Height_{dry}$). When the display again reads 00.00, press the start button again to prompt the tray to automatically raise the water and then record the time display (absorption time, T). The Tester will continue to run for 30 seconds. The water tray will automatically lower and the time will run for another 30 S. When the display reads 20 s, record the wet pad height to the nearest 0.5 mm ($Height_{wet}$). Remove the sample holder, transfer the wet pad to the balance for measurement of $Mass_{wet}$ and shut off the water valve. Specific Absorption Rate (s/g) is $T/Mass_{dry}$. Specific Capacity (g/g) is $(Mass_{wet}-Mass_{dry})/Mass_{dry}$. Wet Bulk (cc/g) is $[19.64\ cm^2 \times Height_{wet}/3]/10$. Dry Bulk is $[19.64\ cm^2 \times Height_{dry}/3]/10$. The reference standard for comparison with the surfactant treated fiber is an identical fiber without the addition of surfactant.

It is generally recognized that softeners and debonders are often available commercially only as complex mixtures rather than as single compounds. While the following discussion will focus on the predominant species, it should be understood that commercially available mixtures would generally be used in practice. Suitable softener, debonder and surfactants will be readily apparent to the skilled artisan and are widely reported in the literature.

Suitable surfactants include cationic surfactants, anionic, and nonionic surfactants that are not substantive to the fiber. According to one embodiment, the surfactant is a non-ionic surfactant. According to one embodiment, the surfactant is a cationic surfactant. According to one embodiment, the surfactant is a vegetable based surfactant, such as a vegetable based fatty acid, such as a vegetable based fatty acid quaternary ammonium salt. Such compounds include DB999 and DB1009, both available from Cellulose Solutions. Other surfactants may be including, but not limited to Berol 388 an ethoxylated nonylphenol ether from Akzo Nobel.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

The surfactant is added in an amount of up to 6 lbs/ton, such as from 0.5 lbs/ton to 3 lbs/ton, such as from 0.5 lbs/ton to 2.5 lbs/ton such as from 0.5 lbs/ton to 2 lbs/ton, such as less than 2 lbs/ton.

The surface active agent may be added at any point prior to forming rolls, bales, or sheets of pulp. According to one embodiment, the surface active agent is added just prior to the headbox of the pulp machine, specifically at the inlet of the primary cleaner feed pump.

According to one embodiment, the fiber of the present invention has an improved filterability over the same fiber without the addition of surfactant when utilized in a viscose process. For example, the filterability of a viscose solution comprising fiber of the invention has a filterability that is at least 10% lower than a viscose solution made in the same way with the identical fiber without surfactant, such as at least 15% lower, such as at least 30% lower, such as at least 40% lower. Filterability of the viscose solution is measured by the following method. A solution is placed in a nitrogen pressurized (27 psi) vessel with a 1 and 3/16ths inch filtered orifice on the bottom—the filter media is as follows from outside to inside the vessel: a perforated metal disk, a 20 mesh stainless steel screen, muslin cloth, a Whatman 54 filter paper and a 2 layer knap flannel with the fuzzy side up toward the contents of the vessel. For 40 minutes the solution is allowed to filter through the media, then at 40 minutes for an additional 140 minutes the (so t=0 at 40 minutes) the volume of filtered solution is measured (weight) with the elapsed time as the X coordinate and the weight of filtered viscose as the Y coordinate—the slope of this plot is your filtration number. Recordings to be made at 10 minute intervals. The reference standard for comparison with the surfactant treated fiber is the identical fiber without the addition of surfactant.

According to one embodiment of the invention, the surfactant treated fiber of the invention exhibits a limited increase in specific absorption rate, e.g., less than 30% with a concurrent decrease in filterability, e.g., at least 10%. According to one embodiment, the surfactant treated fiber has an increased specific absorption rate of less than 30% and a decreased filterability of at least 20%, such as at least 30%, such as at least 40%. According to another embodiment, the surfactant treated fiber has an increased specific absorption rate of less than 25% and a decreased filterability of at least 10%, such as at least about 20%, such as at least 30%, such as at least 40%. According to yet another embodiment, the surfactant treated fiber has an increased specific absorption rate of less than 20% and a decreased filterability of at least 10%, such as at least about 20%, such as at least 30%, such as at least 40%. According to another embodiment, the surfactant treated fiber has an increased specific absorption rate of less than 15% and a decreased filterability of at least 10%, such as at least about 20%, such as at least 30%, such as at least 40%. According to still another embodiment, the surfactant treated fiber has an increased specific absorption rate of less than 10% and an decreased filterability of at least 10%, such as at least about 20%, such as at least 30%, such as at least 40%.

Heretofore the addition of cationic surfactant to pulp bound for the production of viscose was considered detrimental to viscose production. Cationic surfactants attach to the same sites on the cellulose that caustic must react with to begin the breakdown of the cellulose fiber. Thus, it has long been thought that cationic materials should not be used as pulp pre-treatments for fibers used in the production of viscose. Not wishing to be bound by theory it is believed that since the fibers produced according to the present invention differs from prior art fiber in their form, character and chemistry, the cationic surfactant is not binding in the same manner as it did to prior art fibers. Fiber according to the disclosure, when treated with a surfactant according to the invention separates the fiber in a way that improves caustic penetration and filterability. Thus, according to one embodiment fibers of the present disclosure can be used as a substitute for expensive cotton or sulfite fiber to a greater extent than either untreated fiber or prior art fiber has been.

II. Kraft Fibers

Reference is made herein to "standard," "conventional," or "traditional," kraft fiber, kraft bleached fiber, kraft pulp or kraft bleached pulp. Such fiber or pulp is often described as a reference point for defining the improved properties of the present invention. As used herein, these terms are interchangeable and refer to the fiber or pulp which is identical in composition to and processed in a like standard manner without an oxidation step. As used herein, a standard kraft process includes both a cooking stage and a bleaching stage under art recognized conditions. Standard kraft processing does not include a pre-hydrolysis stage prior to digestion an oxidation stage.

Physical characteristics (for example, purity, brightness, fiber length and viscosity) of the kraft cellulose fiber mentioned in the specification are measured in accordance with protocols provided in the Examples section.

In some embodiments, modified kraft fiber of the disclosure has a brightness equivalent to standard kraft fiber. In some embodiments, the modified cellulose fiber has a brightness of at least 89, 90, or 91 ISO. In some embodiments, the brightness is greater than about 91.4 or 91.5 ISO. In some embodiments, the brightness ranges from about 90 to about 91.5

Cellulose according to the present disclosure has an R18 value in the range of from about 87% to about 88.2%, for example, 87.5% to 88.2%, for example, at least about 87%, for example, at least about 87.5%, for example at least about 87.8%, for example at least about 88%.

In some embodiments, kraft fiber according to the disclosure has an R10 value ranging from about 82%, for example, at least about 83%, for example, at least about 84%, for example, at least about 84.5%, for example, at least about 85%. The R18 and R10 content is described in TAPPI T235. R10 represents the residual undissolved material that is left after extraction of the pulp with 10 percent by weight caustic and R18 represents the residual amount of undissolved material left after extraction of the pulp with an 18% caustic solution. Generally, in a 10% caustic solution, hemicellulose and chemically degraded short chain cellulose are dissolved and removed in solution. In contrast, generally only hemicellulose is dissolved and removed in an 18% caustic solution. Thus, the difference between the R10 value and the R18 value, ($\Delta R = R18 - R10$), represents the amount of chemically degraded short chained cellulose that is present in the pulp sample.

In some embodiments, modified cellulose fiber has an S10 caustic solubility ranging from about 14.5% to about 16%, or from about 15% to about 16%, for example, 15% to about 15.5%. In some embodiments, modified cellulose fiber has an S18 caustic solubility less than about 15%, for example, less than about 12.5%, for example, less than about 12.3%, for example, about 12%.

The present disclosure provides kraft fiber with low and ultra-low viscosity. Unless otherwise specified, "viscosity" as used herein refers to 0.5% Capillary CED viscosity measured according to TAPPI T230-om99 as referenced in the protocols.

Unless otherwise specified, "DP" as used herein refers to average degree of polymerization by weight (DPw) calculated from 0.5% Capillary CED viscosity measured according to TAPPI T230-om99. See, J. F. Cellucon Conference in *The Chemistry and Processing of Wood and Plant Fibrous Materials*, p. 155, test protocol 8, 1994 (Woodhead Publishing Ltd., Abington Hall, Abinton Cambridge CBI 6AH England, J. F. Kennedy et al. eds.) "Low DP" means a DP ranging from about 1160 to about 1860 or a viscosity ranging from about 7 to about 13 mPa·s. "Ultra low DP" fibers means a DP ranging from about 350 to about 1160 or a viscosity ranging from about 3 to about 7 mPa·s.

Without wishing to be bound by theory, it is believed that the fiber of the present invention presents an artificial Degree of Polymerization when DP is calculated via CED viscosity measured according to TAPPI T230-om99. Specifically, it is believed that the catalytic oxidation treatment of the fiber of the present invention doesn't break the cellulose down to the extent indicated by the measured DP, but instead largely has the effect of opening up bonds and adding substituents and that make the cellulose more reactive, instead of cleaving the cellulose chain. It is further believed that for the CED viscosity test (TAPPI T230-om99), which begins with the addition of caustic, has the effect of cleaving the cellulose chain at the new reactive sites, resulting in a cellulose polymer which has a much higher number of shorter segments than are found in the fiber's pre-testing state. This is confirmed by the fact that the fiber length is not significantly diminished during production.

In some embodiments, modified cellulose fiber has a viscosity ranging from about 4.0 mPa·s to about 6 mPa·s. In some embodiments, the viscosity ranges from about 4.5 mPa·s to about 6.0 mPa·s. In some embodiments, the viscosity ranges from about 5.0 mPa·s to about 6.0 mPa·s. In some embodiments, the viscosity ranges from about 5.3 mPa·s to about 5.8 mPa·s. In some embodiments, the viscosity is less than 6 mPa·s, for example, less than 5.5 mPa·s, for example, less than 5.0 mPa·s, or for example, less than 4.5 mPa·s.

In some embodiments, kraft fiber of the disclosure maintains its fiber length during the bleaching process.

"Fiber length" and "average fiber length" are used interchangeably when used to describe the property of a fiber and mean the length-weighted average fiber length. Therefore, for example, a fiber having an average fiber length of 2 mm should be understood to mean a fiber having a length-weighted average fiber length of 2 mm.

In some embodiments, when the kraft fiber is a softwood fiber, the cellulose fiber has an average fiber length, as measured in accordance with Test Protocol 12, described in the Example section below, that is about 2 mm or greater. In some embodiments, the average fiber length is no more than about 3.7 mm. In some embodiments, the average fiber length is at least about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, or about 3.7 mm. In some embodiments, the average fiber length ranges from about 2 mm to about 3.7 mm, or from about 2.2 mm to about 3.7 mm.

In some embodiments, modified kraft fiber of the disclosure has increased carboxyl content relative to standard kraft fiber.

In some embodiments, modified cellulose fiber has a carboxyl content ranging from about 3 meq/100 g to about 4 meq/100 g. In some embodiments, the carboxyl content ranges from about 3.2 meq/100 g to about 4 meq/100 g. In some embodiments, the carboxyl content is at least about 3 meq/100 g, for example, at least about 3.2 meq/100 g, for example, at least about 3.3 meq/100 g.

In some embodiments, modified cellulose fiber has a carbonyl content ranging from about 0.8 meq/100 g to about 1.5 meq/100 g. In some embodiments, the carbonyl content ranges from about 1.0 meq/100 g to about 1.5 meq/100 g. In some embodiments, the carbonyl content is less than about 2.0 meq/100 g, for example, less than about 1.5 meq/100 g, for example, less than about 1.3 meq/100 g.

In some embodiments, the modified cellulose fiber has a copper number less than about 1.2. In some embodiments, the copper number is less than about 1.0. In some embodiments, the copper number is less than about 0.9. In some embodiments, the copper number ranges from about 0.4 to about 0.9, such as from about 0.5 to about 0.8.

In at least one embodiment, the hemicellulose content of the modified kraft fiber is substantially the same as standard unbleached kraft fiber. For example, the hemicellulose content for a softwood kraft fiber may range from about 12% to about 17%. For instance, the hemicellulose content of a hardwood kraft fiber may range from about 12.5% to about 16.5%.

The present disclosure provides products made from the modified kraft fiber described herein. In other embodiments, the products are those typically made from cotton linter, pre-hydrolsis kraft or sulfite pulp. More specifically, fiber of the present invention can be used, without further modification, as a starting material in the preparation of chemical derivatives, such as ethers and esters. While these fibers are more likely to be used in the production of chemical derivatives, as will be readily apparent to the skilled artisan, the fibers of the present invention can generally be substituted for standard kraft fiber in any product or process, for example, without limitation, in the production of absorbent products.

III Acid/Alkaline Hydrolyzed Products

In some embodiments, this disclosure provides an oxidized kraft fiber that can be used as a substitute for cotton linter or sulfite pulp. In some embodiments, this disclosure provides an oxidized kraft fiber that can be used as a substitute for cotton linter or sulfite pulp in the manufacture of cellulose ethers, cellulose acetates and microcrystalline cellulose.

Phrases such as "which can be substituted for cotton linter (or sulfite pulp) . . . " and "interchangeable with cotton linter (or sulfite pulp) . . . " and "which can be used in place of cotton linter (or sulfite pulp) . . . " and the like mean only that the fiber has properties suitable for use in the end application normally made using cotton linter (or sulfite pulp or pre-hydrolysis kraft fiber). The phrase is not intended to mean that the fiber necessarily has all the same characteristics as cotton linter (or sulfite pulp).

Without being bound by theory, it is believed that the increase in aldehyde content relative to conventional kraft pulp provides additional active sites for etherification to end-products such as carboxymethylcellulose, methylcellulose, hydroxypropylcellulose, and the like, while reducing the viscosity, enabling production of a fiber that can be used with much success in the production of cellulose derivatives.

In some embodiments, the oxidized kraft fiber has chemical properties that make it suitable for the manufacture of cellulose ethers. Thus, the disclosure provides a cellulose ether derived from a oxidized kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the oxidized kraft fiber has chemical properties that make it suitable for the manufacture of cellulose esters. Thus, the disclosure provides a cellulose ester, such as a cellulose acetate, derived from oxidized kraft fibers of the disclosure. In some embodiments, the disclosure provides a product comprising a cellulose acetate derived from the oxidized kraft fiber of the disclosure. For example, and not by way of limitation, the cellulose esters of the disclosure may be used in, home furnishings, cigarette filters, inks, absorbent products, medical devices, and plastics including, for example, LCD and plasma screens and windshields.

In some embodiments, the oxidized kraft fiber of the disclosure may be suitable for the manufacture of viscose. More particularly, the oxidized kraft fiber of the disclosure may be used as a partial substitute for expensive cellulose starting material. The oxidized kraft fiber of the disclosure may replace as much as 15% or more, for example as much as 10%, for example as much as 5%, of the expensive cellulose starting materials. Thus, the disclosure provides a viscose fiber derived in whole or in part from an oxidized kraft fiber, as described. In some embodiments, the viscose is produced from oxidized kraft fiber of the present disclosure that is treated with alkali and carbon disulfide to make a viscose solution, which is then spun into dilute sulfuric acid and sodium sulfate to reconvert the viscose into cellulose. It is believed that the viscose fiber of the disclosure may be used in any application where viscose fiber is traditionally used. For example, and not by way of limitation, the viscose of the disclosure may be used in rayon, cellophane, filament, food casings, and tire cord.

In some embodiments, the kraft fiber is suitable for the manufacture of microcrystalline cellulose. Microcrystalline cellulose production requires relatively clean, highly purified starting cellulosic material. As such, traditionally, expensive sulfite pulps have been predominantly used for its production. The present disclosure provides microcrystalline cellulose derived from kraft fiber of the disclosure. Thus, the disclosure provides a cost-effective cellulose source for microcrystalline cellulose production.

The cellulose of the disclosure may be used in any application that microcrystalline cellulose has traditionally been used. For example, and not by way of limitation, the cellulose of the disclosure may be used in pharmaceutical or nutraceutical applications, food applications, cosmetic applications, paper applications, or as a structural composite. For instance, the cellulose of the disclosure may be a binder, diluent, disintegrant, lubricant, tableting aid, stabilizer, texturizing agent, fat replacer, bulking agent, anticaking agent, foaming agent, emulsifier, thickener, separating agent, gelling agent, carrier material, opacifier, or viscosity modifier. In some embodiments, the microcrystalline cellulose is a colloid.

Other products comprising cellulose derivatives and microcrystalline cellulose derived from kraft fibers according to the disclosure may also be envisaged by persons of ordinary skill in the art. Such products may be found, for example, in cosmetic and industrial application.

Fiber for use in the production of chemical derivatives can be sensitive to the level of functionality that has been imparted by the oxidation process. Specifically, aldehyde groups can be a source of brightness reversion as the fiber ages. Fiber for use in the production of chemical derivatives and viscose ideally has a low viscosity and concurrently a low aldehyde content. The addition of oxygen to any of the oxidation stages has little effect on viscosity but materially reduces the aldehyde functionality of the fiber. Further, the fiber does not exhibit an increased carboxyl content. Without wishing to be bound by theory, it is believed that the aldehyde groups are being oxidized to carbon dioxide and are released.

Thus, according to one embodiment of the invention oxygen is introduced at one or more of the oxidation stages to reduce the level of aldehyde functionality. The use of oxygen during the oxidation process can be used to reduce aldehyde content in process where the fiber is later treated with a carboxylating acid and in processes where it is not. Fiber that has been treated in an oxidation stage that includes oxygen can have an aldehyde content of less than about 4 meq/100 g, for example, less than 3.5 meq/100 g, for example, less than 3.2 meq/100 g.

The levels of oxygen added to the oxidation stage are from about 0.1% to about 1%, for example from about 0.3% to about 0.7%, for example, from about 0.4% to about 0.5%, for about 0.5% to about 0.6%.

IV. Fluff Products Made from Kraft Fibers

While the fibers of the present invention are more likely to be used in the production of chemical derivatives, they can nonetheless be substituted for standard kraft fiber in any product or process. Therefore, in some embodiments, the disclosure provides a method for producing fluff pulp. For example, the method comprises bleaching kraft fiber in a multi-stage bleaching process, and then forming a fluff pulp. In at least one embodiment, the fiber is not refined after the multi-stage bleaching process.

In some embodiments, the products are absorbent products, including, but not limited to, medical devices, including wound care (e.g. bandage), baby diapers nursing pads, adult incontinence products, feminine hygiene products, including, for example, sanitary napkins and tampons, air-laid non-woven products, air-laid composites, "table-top" wipers, napkin, tissue, towel and the like. Absorbent products according to the present disclosure may be disposable. In those embodiments, fiber according to the invention can be used as a whole or partial substitute for the bleached hardwood or softwood fiber that is typically used in the production of these products.

In some embodiments, the kraft fiber of the present invention is in the form of fluff pulp and has one or more properties that make the kraft fiber more effective than conventional fluff pulps in absorbent products. More specifically, kraft fiber of the present invention may have improved compressibility which makes it desirable as a substitute for currently available fluff pulp fiber. Because of the improved compressibility of the fiber of the present disclosure, it is useful in embodiments which seek to produce thinner, more compact absorbent structures. One skilled in the art, upon understanding the compressible nature of the fiber of the present disclosure, could readily envision absorbent products in which this fiber could be used. By way of example, in some embodiments, the disclosure provides an ultrathin hygiene product comprising the kraft fiber of the disclosure. Ultra-thin fluff cores are typically used in, for example, feminine hygiene products or baby diapers. Other products which could be produced with the fiber of the present disclosure could be anything requiring an absorbent core or a compressed absorbent layer. When compressed, fiber of the present invention exhibits no or no substantial loss of absorbency, but shows an improvement in flexibility.

Fiber of the present invention may, without further modification, also be used in the production of absorbent products including, but not limited to, tissue, towel, napkin and other paper products which are formed on a traditional papermaking machine. Traditional papermaking processes involve the preparation of an aqueous fiber slurry which is typically deposited on a forming wire where the water is thereafter removed. The kraft fibers of the present disclosure may provide improved product characteristics in products including these fibers.

In some embodiments, the kraft fiber is combined with at least one super absorbent polymer (SAP). In some embodiments, the SAP may by an odor reductant. Examples of SAP that can be used in accordance with the disclosure include, but are not limited to, Hysorb™ sold by the company BASF, Aqua Keep® sold by the company Sumitomo, and FAVOR®, sold by the company Evonik.

In some embodiments, the disclosure provides a method for controlling odor, comprising providing a oxidized bleached kraft fiber according to the disclosure, and applying an odorant to the bleached kraft fiber such that the atmospheric amount of odorant is reduced in comparison with the atmospheric amount of odorant upon application of an equivalent amount of odorant to an equivalent weight of standard kraft fiber. In some embodiments the disclosure provides a method for controlling odor comprising inhibiting bacterial odor generation. In some embodiments, the disclosure provides a method for controlling odor comprising absorbing odorants, such as nitrogenous odorants, onto a modified kraft fiber. As used herein, "nitrogenous odorants" is understood to mean odorants comprising at least one nitrogen.

As used herein, "about" is meant to account for variations due to experimental error. All measurements are understood to be modified by the word "about", whether or not "about" is explicitly recited, unless specifically stated otherwise. Thus, for example, the statement "a fiber having a length of 2 mm" is understood to mean "a fiber having a length of about 2 mm."

The details of one or more non-limiting embodiments of the invention are set forth in the examples below. Other embodiments of the invention should be apparent to those of ordinary skill in the art after consideration of the present disclosure.

EXAMPLES

Test Protocols

1. Caustic solubility (R10, S10, R18, S18) is measured according to TAPPI T235-cm00.
2. Carboxyl content is measured according to TAPPI T237-cm98.
3. Aldehyde content is measured according to Econotech Services LTD, proprietary procedure ESM 055B.
4. Copper Number is measured according to TAPPI T430-cm99.
5. Carbonyl content is calculated from Copper Number according to the formula: carbonyl=(Cu. No.−0.07)/0.6, from *Biomacromolecules* 2002, 3, 969-975.
6. 0.5% Capillary CED Viscosity is measured according to TAPPI T230-om99.
7. Intrinsic Viscosity is measured according to ASTM D1795 (2007).

8. DP is calculated from 0.5% Capillary CED Viscosity according to the formula: DPw=−449.6+598.4 ln(0.5% Capillary CED)+118.02 $\ln^2$(0.5% Capillary CED), from the 1994 Cellucon Conference published in *The Chemistry and Processing Of Wood And Plant Fibrous Materials*, p. 155, woodhead Publishing Ltd, Abington Hall, Abington, Cambridge CBI 6AH, England, J. F. Kennedy, et al. editors.
9. Carbohydrates are measured according to TAPPI T249-cm00 with analysis by Dionex ion chromatography.
10. Cellulose content is calculated from carbohydrate composition according to the formula: Cellulose=Glucan−(Mannan/3), from *TAPPI Journal* 65(12):78-80 1982.
11. Hemicellulose content is calculated from the sum of sugars minus the cellulose content.
12. Fiber length and coarseness is determined on a Fiber Quality Analyzer™ from OPTEST, Hawkesbury, Ontario, according to the manufacturer's standard procedures.
13. DCM (dichloromethane) extractives are determined according to TAPPI T204-cm97.
14. iron content is determined by acid digestion and analysis by ICP.
15. Ash content is determined according to TAPPI T211-om02.
16. Brightness is determined according to TAPPI T525-om02.
17. CIE Whiteness is determined according to TAPPI Method T560

Example 1

Methods of Preparing Fibers of the Disclosure

Southern pine chips were cooked in a two vessel continuous digester with Lo-Solids© downflow cooking. The white liquor application was 18.7% as effective alkali (EA) with half being added in the impregnation vessel and half being added in the quench circulation. The quench temperature was 165° C. The kappa no. after digesting averaged 14. The brownstock pulp was further delignified in a two stage oxygen delignification system with 2.84% sodium hydroxide (NaOH) and 1.47% oxygen ($O_2$) applied. The temperature was 92 to 94° C. The Kappa number was 5.6.

The oxygen delignified pulp was bleached in a 5 stage bleach plant. The first chlorine dioxide stage (D0) was carried out with 0.71% chlorine dioxide ($ClO_2$) applied at a temperature of 63° C. and a pH of 2.5. The Kappa number following the ($D_0$) stage was 1.7

The second stage was altered to produce a low degree of polymerization pulp. Ferrous sulfate heptahydrate ($FeSO_4.7H_2O$) was added as a 2.5 lb/gal aqueous solution at a rate to provide 25 ppm $Fe^{+2}$, which was increased to 40 ppm $Fe^{+2}$ on pulp. The pH of the stage was 2.8 and the temperature was 82° C. $H_2O_2$ was applied at 0.25% on pulp at the suction of the stage feed pump.

The third or chlorine dioxide stage (D1) was carried out at a temperature of 79.5° C. and a pH of 2.9, $ClO_2$ was applied at 0.90% and NaOH at 10.43%. The 0.5% Capillary CED viscosity was between 5.4 and 6.1 mPa·s.

The fourth or alkaline extraction stage (EP) was carried out at a temperature of 76° C. NaOH was applied at 1.54%, and hydrogen peroxide ($H_2O_2$) at 0.28%. The pH was 11.3

The fifth or final chlorine dioxide stage (D2) was carried out at a temperature of 72° C., and a pH of 4.4 with 0.14% $ClO_2$ applied.

Fibers were produced and baled or reeled or finished with a surfactant treatment. Sample 1 below was reeled, but no surfactant was added. Samples 2-4 contained added surfactant. Samples 3 and 4 were baled. Results are set forth in the Table below.

TABLE 1

| Sample | | 1 | 2 | 3 | 4 |
|---|---|---|---|---|---|
| R10 | % | 84.2 | 84.3 | 84.7 | 84.7 |
| S10 | % | 15.8 | 15.7 | 15.3 | 15.3 |
| R18 | % | 87.8 | 87.6 | 88.0 | 88.0 |
| S18 | % | 12.2 | 12.4 | 12.0 | 12.0 |
| ΔR | | 3.6 | 3.3 | 3.3 | 3.3 |
| Carboxyl | meq/100 g | 3.8 | 3.68 | 3.72 | 3.74 |
| Aldehydes | meq/100 g | 0.74 | 1.97 | 1.00 | 2.25 |
| Copper No. | | 0.69 | 0.74 | 0.74 | 0.71 |
| Calculated Carbonyl* | mmole/100 g | 1.03 | 1.12 | 1.12 | 1.07 |
| CED Viscosity | mPa · s | 6.0 | 5.8 | 5.7 | 5.7 |
| Calculated Intrinsic Visc. | [h] dl/g | 4.17 | 4.06 | 3.97 | 3.97 |
| Calculated DP*** | $DP_w$ | 1001 | 967 | 941 | 941 |
| Glucan | % | 82.9 | 82.5 | 83.1 | 78.4 |
| Xylan | % | 7.4 | 7.5 | 7.4 | 6.8 |
| Galactan | % | 0.3 | 0.2 | 0.2 | 0.2 |
| Mannan | % | 5.8 | 5.7 | 5.9 | 5.4 |
| Arabinan | % | 0.3 | 0.2 | 0.2 | 0.2 |
| Calculated Cellulose** | % | 81.0 | 80.6 | 81.1 | 76.6 |
| Calculated Hemicelllulose | % | 15.7 | 15.5 | 15.7 | 14.4 |
| Sum Sugars | | 96.7 | 96.1 | 96.8 | 91.0 |
| Iron | ppm | 2.74 | 2.7 | 3.22 | 3.48 |

Comparative Example 2

The fiber of the invention prepared according to Example 1 was compared with fiber prepared according to published International Application No. WO 2010/138941. Also, the fiber as prepared according to Example 1 was compared to a fiber (Sample 1 with surfactant) that was pulped and digested as described in published International Application No. WO 2012/038685, which is incorporated herein by reference in its entirety, and then oxidized in the fourth stage of a five stage bleaching process as described in published International Application No. WO 2010/138941.

TABLE 2

| Sample | | Comp. Sample 1 with surf. | Invention with surfactant | WO 2010/138941 with surfactant | WO 2010/138941 without surfactant |
|---|---|---|---|---|---|
| Viscosity | mPa · s | 5.1 | 5.65 | 6.57 | 6.5 |
| R10 | % | 81.6 | 84.7 | 86.1 | 86.0 |
| R18 | % | 86.1 | 88.0 | 88.1 | 88.2 |
| Carboxyl | meq/100 g | 3.3 | 3.74 | 3.32 | 3.39 |
| Aldehydes | meq/100 g | 1.44 | 2.5 | 0.19 | 0.45 |
| Copper No. | | 0.71 | 1.5 | 0.44 | 0.41 |
| Calculated Carbonyl* | mmole/100 g | 2.4 | 1.07 | 0.62 | 0.57 |
| Glucan | % | 85.6 | 86.1 | 85.4 | 86.2 |
| Xylan | % | 8.0 | 7.5 | 7.9 | 7.5 |
| Galactan | % | 0.2 | 0.2 | 0.2 | 0.2 |
| Mannan | % | 6.1 | 6.0 | 6.2 | 5.9 |
| Arabinan | % | 0.2 | 0.2 | 0.2 | 0.2 |
| Iron | ppm | 13.9 | 3.48 | 1.83 | 2.48 |

Example 3

Characteristics of fiber samples of Example 1 and other produced in the same manner as Example 1 above, including whiteness and brightness were measured. The results are reported below.

| Pulp Sheet Characteristics | | Sample 1 | Sample 2 | Sample 3 | Sample 4 |
|---|---|---|---|---|---|
| Fiber of Example 1 | | | | | |
| ISO Surface Brightness | % | 91.1 | | 91.5 | 91.5 |
| L | | 98.08 | | 98.04 | 98.04 |
| a | | −0.87 | | −0.85 | −0.82 |
| b | | 2.68 | | 2.63 | 2.65 |
| Calculated CIE Whiteness | | 83.1 | | 83.2 | 83.1 |
| Additional Fiber produced as in Example 1 | | | | | |
| ISO Surface Brightness | % | 91.5 | 91.1 | 91.0 | 91.6 |
| L | | 98.08 | 97.87 | 91.0 | 98.06 |
| a | | −0.87 | −0.88 | −0.92 | −0.82 |
| b | | 2.68 | 2.62 | 2.77 | 2.58 |
| Calculated CIE Whiteness | | 83.1 | 82.8 | 82.2 | 93.5 |

Example 4

Samples produced in the same manner as Example 1 above, were tested for brightness reversion. The accelerated revision was measured according to TAPPI UM 200. Samples were measure for brightness and color and then placed into an over at 105° C. for 4 hours. The brightness and color were again measured. The results are reported below.

| | Color and Brightness | | | | | | |
|---|---|---|---|---|---|---|---|
| Sample | L* | a* | b* | Bright ISO | White CIE | k/s | Post Color No. |
| Brightness reversion | | | | | | | |
| Inventive sample | 98.0 | −0.78 | 2.7 | 91.2 | 82.7 | 0.00423 | |
| Inventive Sample reverted* | 97.3 | −0.81 | 3.15 | 90.2 | 80.3 | 0.00532 | 0.11 |
| Comparative example | | | | | | | |
| Comparative Sample 1 initial | | | | 90 | | 0.0056 | |
| Comparative Sample 1, 7 months old | 97.3 | −0.58 | 3.63 | 88.2 | 76.7 | 0.0079 | |
| Comparative Sample 1 reverted* | 96.7 | −0.41 | 4.27 | 86.1 | 72.4 | 0.0112 | 0.33 |

All color measurements were done with Technidyne Color touch PC with C/2° illumant. k/s is the ratio of the absorption coefficient (k)/scattering coefficient(s). k is directed affected by chromophores or color bodies in the pulp, so a change in k/s upon aging gives a direct measure of the amount of chromophore formed, k/s is calculated according to the formula:

$$k/s=(1-R_\infty)^2/2*R_\infty \text{ where } R\infty=\text{Brightness}/100.$$

PC, or post color, is a measure of the change in k/s upon aging and is a more direct measure or reversion than the change in brightness. PC is calculated according to the formula:

$$\text{PC No.}=100*(k/s \text{ aged}--k/s \text{ initial})$$

As can be seen from the results above, and those below, the fiber of the present disclosure has exceptional brightness, e.g., greater than 90 with good anti-yellowing characteristics, e.g., brightness reversion, characteristics. The enhanced brightness and limited reversion make this fiber particularly useful in the production of viscose and other cellulose derivative products.

Example 5

Samples according to Example 1, as well as comparative Samples according to Example 2 were tested for caustic yellowing. Caustic yellowing was measure on 3"×3" squares from dryer sheets of each sample grade. L*a*b* and brightness were measured on the initial samples placed in a plastic sleeve. Each square was soaked in 30 mls of an 18% NaOH solution for 5 minutes. The saturated squares were placed in a plastic sleeve and the brightness and L*a*b* values were measured by a MiniScan XE meter. Results are set forth below.

| | Color and Brightness | | | | | | |
|---|---|---|---|---|---|---|---|
| Sample | L* | a* | b* | Bright ISO | White CIE | k/s | Post Color No. |
| Inventive Sample | 96.72 | −0.92 | 2.81 | 88.35 | | 0.00769 | |
| Caustic treated Inventive Sample | 76.43 | −1.63 | 8.24 | 44 | | 0.357 | 34.9 |
| Comparative example | | | | | | | |
| Comparative Sample 1, | 96.17 | −0.49 | 3.5 | 86.04 | | 0.0113 | |
| Comparative Sample 1 caustic treated | 75.79 | −2.49 | 17.71 | 36.1 | | 0.5677 | 55.6 |
| WO 2010/138941 without surfactant | 96.92 | −0.83 | 1.75 | 90.23 | | 0.00529 | |
| Same treated with Caustic | 77.1 | −1.7 | 5.4 | 48.04 | | 0.294 | 28.9 |

Example 6

Fiber of the present invention was used to form a simulated viscose dope and tested for filterability, optical properties and viscosity. The test mixture was 20% fiber according to the present invention and 80% Century Pulp & Paper Eucalyptus DWP fiber with a viscosity of 7.1 mPa·s and an R18 of 96%, a typical base cellulose for a standard viscose recipe. In addition to the pulp of the invention, the Century Pulp & Paper Eucalyptus DWP was also tested alone, and with 20% of Buckeye Technologies V67 rayon grade pulp with a viscosity of 5.3 mPa·s and R18 of 96%. Results are set forth below.

| Slurry Steep | CP&P Pulp Blend | 20% Prior GP fiber with Surfactant | 20% Buck-eye V67 | 20% Inven-tive Fiber with Sur-factant | 20% Inven-tive fiber with Sur-factant |
|---|---|---|---|---|---|
| Alkali Cellulose | | | | | |
| % NaOH | 17.8 | 17.8 | 17.8 | 17.8 | 17.8 |
| Temperature (° C.) | 45 | 45 | 45 | 45 | 45 |
| Time (min) | 30 | 30 | 30 | 30 | 30 |
| P.W.R. (Press Weight Ratio) | 2.95 | 2.93 | 2.95 | 2.90 | 2.90 |
| % Cellulose | 32 | 30.16 | 32.12 | 33.75 | 32.11 |
| % NaOH | 16 | 15.7 | 16.11 | 16.33 | 15.82 |
| % Na2CO3 | <1.0 | 0 | 0 | 0 | 0 |
| Aging Temperature (° C.) | 46.5 | 46.5 | 46.5 | 46.5 | 46.5 |
| Aging time (Hrs) | 7 hrs | 7 hrs | 7 hrs | 7 hrs | 7 hrs |
| Final viscosity (1% CED, cps) | | 10.50 | 10.03 | 10.18 | 9.67 |
| Xanthation | | | | | |
| % CS2 on cellulose | 32 | 32 | 32 | 32 | 32 |
| Time (min) | 45-90 | 90 | 90 | 90 | 90 |
| Temp (° C.) | 31 | 31 | 31 | 31 | 31 |
| 70% Vacuum recovery, min | | 43 | 42 | 43 | 43 |
| Viscose solution | | | | | |
| % Cellulose | 9 | 9 | 9 | 9 | 9 |
| % NaOH | 5.5 | 5.5 | 5.5 | 5.5 | 5.5 |
| Mixing time (min) | 90 | 90 | 90 | 90 | 90 |
| Mixing bath temp. (° C.) | 15 | 15 | 15 | 15 | 15 |
| Ripening temperature (° C.) | 18 | 18 | 18 | 18 | 18 |

-continued

| Slurry Steep | CP&P Pulp Blend | 20% Prior GP fiber with Surfactant | 20% Buck-eye V67 | 20% Inven-tive Fiber with Sur-factant | 20% Inven-tive fiber with Sur-factant |
|---|---|---|---|---|---|
| Ripening time (hrs) | 19 | 19 | 19 | 19 | 19 |
| Viscose Quality | | | | | |
| Filterability (X 1000) | <60 | 41 | 33 | 34 | 22 |
| Haze | 90 to 170 | 143 | 118 | 136 | 86 |
| Clarity, cm | 3.5 to 8 | 221 | 203 | 191 | 216 |
| 19 Hr. Ball Fall (sec.) | 40 to 90 | 50 | 46 | 36 | 38 |
| Gel content (%) | <0.25 | 0.22 | 0.20 | 0.19 | 0.20 |

The prior GP comparative fiber was made by the process described in PCT US/2012/038685 filed May 18, 23012.

As shown in the table above, viscose produced with the fiber of the present invention has similar, if not improved, filtration properties compared to viscose produced with 100% Century DWP or 80/20 blends with Century CPP and Buckeye V67. Using the V67 filtration as a point of reference, we observed a 33% increase in performance with the fiber of the present invention.

Examples 7-11

The fibers of these examples were prepared essentially according to the methods of Example 1. Examples 7 and 8 were run with no oxygen during the oxidation stage while Examples 9, 10, and 11 were run with oxygen at 90 PSI during the oxidation stage. In Example 11, oxygen was applied with hydrogen peroxide after process temperature was reached. Oxygen retention time was the first 9 minutes. As can be seen from these examples, when oxygen was used during the oxidation stage, the viscosity remained low while reducing level of aldehydes. Results are set forth below.

| | | Example | | | | |
|---|---|---|---|---|---|---|
| | | 7 | 8 | 9 | 10 | 11 |
| Stage | | E1 oxidation | E1 oxidation | E1 oxidation | E1 oxidation | E1 oxidation |
| Time | min | 90 | 90 | 90 | 90 | 90 |
| Temp. | ° C. | 80 | 80 | 80 | 80 | 80 |
| Chemical | | 1.0% $H_2O_2$ 150 ppm $Fe^{+2}$ | 1.5% $H_2O_2$ 150 ppm $Fe^{+2}$ | 1.0% $H_2O_2$ 150 ppm $Fe^{+2}$ | 1.5% $H_2O_2$ 150 ppm $Fe^{+2}$ | 1.5% $H_2O_2$ 150 ppm $Fe^{+2}$ |
| pH | Initial | 3.58 | 3.56 | 3.6 | 3.67 | 3.63 |
| | Final | 3.11 | 2.78 | 2.86 | 2.77 | 2.95 |
| Residual $H_2O_2$ | % on pulp | 0 | 0 | 0 | 0 | 0.147 |
| Viscosity | cps | 3.78 | 3.28 | 3.78 | 3.56 | 3.52 |
| Process Type | | Water Bath | Water Bath | Parr Reactor | Parr Reactor | Parr Reactor |
| Oxygen | PSI | n/a | n/a | 90 | 90 | 90 |
| Carboxyl | meq/100 g | 4.16 | 3.72 | 3.89 | 4.25 | 3.62 |
| Aldehyde | meq/100 g | 4.31 | 5.92 | 3.38 | 3.32 | 3.29 |
| Copper No. | | 3.58 | 3.74 | 3.09 | 3.64 | 3.41 |
| Carbonyl | meq/100 g | 5.85 | 6.12 | 5.03 | 5.95 | 5.57 |

A number of embodiments have been described. Nevertheless, it will be understood that various modifications may be made without departing from the spirit and scope of the disclosure. Accordingly, other embodiments are within the scope of the following claims.

We claim:

1. A method for making an oxidized kraft pulp comprising:

continuously digesting a softwood cellulose pulp in a kraft process to form a cellulose kraft pulp with a kappa number of from about 10 to about 16;

oxygen delignifying the cellulose kraft pulp to a kappa number of less than 6.5;

bleaching the cellulose kraft pulp using a multi-stage bleaching process; and oxidizing the cellulose kraft pulp during at least one stage of the multi-stage bleaching process with a peroxide and a catalyst under acidic condition, wherein the multi-stage bleaching process comprises at least one alkaline bleaching stage following the oxidation bleaching stage and at least one chlorine dioxide bleaching stage following both the oxidation bleaching stage and the alkaline bleaching stage.

2. The method of claim 1, wherein the softwood is southern pine fiber.

3. The method of claim 1, wherein the catalyst is chosen from at least one of copper and iron.

4. The method of claim 3, wherein the catalyst is present in an amount of from about 25 ppm to about 100 ppm.

5. The method of claim 3, wherein the peroxide is hydrogen peroxide.

6. The method of claim 5, wherein the hydrogen peroxide is present in an amount of from 0.1% to about 0.5%.

7. The method of claim 1, wherein the pH of the oxidation stage ranges from about 2 to about 6.

8. The method of claim 1, wherein oxygen is applied during the oxidation stage.

9. The method of claim 8, where oxygen is applied at at least about 90 PSI.

10. The method of claim 8, wherein the cellulose kraft pulp treated with added oxygen exhibits a higher carboxylic acid content and a lower aldehyde content than a cellulose kraft pulp treated in the same manner without the addition of oxygen to the oxidation stage.

11. The method of claim 6, wherein the brightness is at least about 90.

12. The method of claim 7, wherein the digestion is carried out in two stages including an impregnator and a co-current down-flow digester.

13. The method of claim 1, wherein the at least one alkaline bleaching stage comprises treatment with NaOH.

14. The method of claim 13, wherein the at least one alkaline bleaching stage comprises treatment with NaOH and hydrogen peroxide.

15. The method of claim 13, wherein the at least one alkaline bleaching stage comprises treatment with NaOH and a peroxygen compound.

16. The method of claim 1, wherein the multi-stage bleaching process is a five-stage bleaching process.

17. The method of claim 16, wherein the second bleaching stage is an oxidation bleaching stage, the fourth bleaching stage is an alkaline bleaching stage, and the fifth bleaching stage is a chlorine dioxide bleaching stage.

* * * * *